US006281870B1

(12) United States Patent
Hayashi

(10) Patent No.: US 6,281,870 B1
(45) **Date of Patent: *Aug. 28, 2001**

(54) ACTIVE MATRIX DISPLAY DEVICE WITH PERIPHERALLY-DISPOSED DRIVING CIRCUITS

(75) Inventor: Yuji Hayashi, Kanagawa (JP)

(73) Assignee: Sony Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/806,405

(22) Filed: Feb. 26, 1997

(30) Foreign Application Priority Data

Feb. 27, 1996 (JP) ..... 8-067080

(51) Int. Cl.[7] ..... G09G 3/36

(52) U.S. Cl. ..... 345/100; 345/92; 345/99; 345/212; 345/213

(58) Field of Search ..... 345/87, 90, 92, 345/98, 99, 100, 212, 213, 214

(56) References Cited

U.S. PATENT DOCUMENTS

| | | | | |
|---|---|---|---|---|
| 4,748,444 | * | 5/1988 | Arai | 345/99 |
| 5,028,916 | * | 7/1991 | Ichikawa et al. | 345/98 |
| 5,051,739 | * | 9/1991 | Hayashida et al. | 345/90 |
| 5,151,689 | * | 9/1992 | Kabuto et al. | 345/103 |
| 5,448,384 | * | 9/1995 | Uchino et al. | 359/59 |

FOREIGN PATENT DOCUMENTS

| | | |
|---|---|---|
| 0 177 247 A2 | 4/1986 | (EP) . |
| 0 269 744 A1 | 6/1988 | (EP) . |
| 0 391 654 A2 | 10/1990 | (EP) . |

OTHER PUBLICATIONS

International Symposium of the SID, Anaheim, May 24–26, 1988, vol. 19, No. 1988, Society for Information Display, pp. 400–403, XP000040236, Sakai et al., "21.1: A Defect–Tolerant Technology For An Active–Matrix LCD Integrated With Peripheral Circuits".

* cited by examiner

*Primary Examiner*—Almis R. Jankus
*Assistant Examiner*—Amr Awad
(74) *Attorney, Agent, or Firm*—Sonnenschein, Nath & Rosenthal

(57) ABSTRACT

An active matrix display device includes a plurality of gate lines and a plurality of data lines, which are arranged in a screen so as to be mutually perpendicular, and pixels arranged at the intersections of both lines, which are selectively driven via the gate lines and the data lines. Also, a vertical driving circuit is disposed outside the screen, and outputs selection pulses sequentially selecting each gate line. In addition, a horizontal driving circuit is similarly disposed outside the screen, and outputs selection pulses sequentially selecting each data line. This horizontal driving circuit includes an address counter for counting the number of clock signals inputted from the exterior and sequentially outputting an address signal, and a plurality of decoders for decoding the address signal and sequentially outputting the selection pulses.

8 Claims, 5 Drawing Sheets

2
3
SIG
Vcom
X
Y
6
ADDRESS DECODERS
ADDRESS DECODERS
ADDRESS DECODERS
ADDRESS DECODERS
5
4
ADDRESS COUNTER
D1
D2
D3
D4
Dn
HCK
HRT
HSW
φ
Cs
LC
Tr
VRT
VCK
VERTICAL DRIVING CIRCUIT
1

ACTIVE MATRIX DISPLAY DEVICE WITH PERIPHERALLY-DISPOSED DRIVING CIRCUITS

BACKGROUND OF THE INVENTION

1. Field of the Invention

The present invention relates to an active matrix display device in which pixels arranged in a matrix and driving circuits disposed peripheral thereto are formed so as to be incorporated, and in particular to the structure of such a peripheral circuit.

2. Description of the Related Art

By referring to FIG. 6, an example of a conventional active matrix display device will be briefly described.

The display device has pixels LC arranged in a matrix as shown in the figure. The respective pixels include pixel electrodes formed on one substrate and counter electrodes formed on another substrate, with an electro-optical material such as liquid crystal provided therebetween. A predetermined voltage $V_{com}$ is applied to the counter electrodes. The respective pixels LC are connected in parallel to additional capacitors Cs. In addition, thin film transistors Tr are formed so as to be integrated, as switching devices for driving the respective pixels LC. Gate lines X are arranged along the row direction of the pixels LC arranged in a matrix, while data lines Y are arranged along the column direction perpendicular thereto. The source electrodes of the thin film transistors are connected to the corresponding data lines Y, while the gate electrodes are connected to the corresponding gate lines X.

The display device further includes a vertical driving circuit 101 and a horizontal driving circuit 102. The vertical driving circuit 101 sequentially outputs selection pulses to the gate lines X, enabling the thin film transistors Tr on the same gate line to be conductive, and performs line-sequential-scanning of the pixels LC in line units. The vertical driving circuit 101 sequentially transfers a vertical start signal VST that is inputted from an external timing generator, in synchronism with a vertical clock signal VCK which is similarly inputted from the timing generator, and thereby outputs the above-mentioned selection pulses. Also, the horizontal driving circuit 102 controls switching of switches HSW connected to the respective data lines Y. The data line Y are supplied with a video signal SIG that is separated into three primary color components of red, green and blue. In synchronism with a horizontal clock signal HCK inputted from the external timing generator, the horizontal driving circuit 102 outputs selection pulses, which control switching of the switches HSW, by sequentially transferring a horizontal start signal HST similarly inputted from the timing generator in one horizontal period. Thereby, the video signal is written into the pixels LC in the row selected in each horizontal period.

FIG. 7 shows a block diagram of an example of the detailed structure of the horizontal driving circuit 102. The vertical driving circuit 101 also has a similar structure. The horizontal driving circuit 102 outputs the selection pulses $\phi$ for sequentially switching the switches HSW shown in FIG. 6. The horizontal driving circuit 102 consists of D-type flip-flops (D-F/F) connected in series in multistages which correspond to the number of the pixel columns. When receiving the clock signal HCK, the horizontal driving circuit 102 sequentially transfers the start signals HST, and thereby outputs the selection pulses $\phi$.

Also in active matrix display devices having a screen consisting of matrix-arranged pixels and peripheral driving circuits, the screen has been being developed for larger size and higher resolution. This case increases the number of connected D-F/F which are included in a shift register which constitutes a driving circuit. As shown in FIG. 7, if a defect occurs in part of the D-F/Fs connected in series or at a connection, the horizontal start signal HST is not transferred after where the defect occurs, and selection pulses are not outputted in the remaining stages. Consequently, video signals cannot be written into the portions of the screen corresponding to the remaining stages, which thus causes a fatal inferior display. In addition, according to the conventional driving circuit using the shift register, the sequence of the selection pulses outputted becomes uniform, which makes it difficult to perform various displays with respect to the screen.

SUMMARY OF THE INVENTION

Accordingly, it is an object of the present invention to provide an active matrix display device in which pixels arranged in a matrix and driving circuits disposed peripheral thereto are formed so as to be incorporated.

According to the present invention, the foregoing object is achieved through the provision of an active matrix display device including: a plurality of gate lines and a plurality of data lines formed on a substrate so as to be mutually perpendicular; pixels arranged at the intersections of the gate lines and the data lines, the pixels being driven via the gate lines and the data lines; a first driving circuit formed on the substrate, for outputting selection pulses selecting each gate line; and a second driving circuit formed on the substrate, for outputting selection pulses selecting each data line, the first driving circuit and/or the second driving circuit including an address counter for counting the number of clock signals inputted from the exterior and sequentially outputting an address signal, and a plurality of address decoders for decoding the address signal and sequentially outputting selection pulses.

Preferably, the address counter supplies the address signal as parallel bit data to address lines, and each address decoder connected in common to the address lines decodes the parallel bit data and outputs selection pulses when an address signal assigned to each address decoder is inputted.

The address counter may supply the address signal with it separated into an upper address signal and a lower address signal, and the active matrix display device may include selectors for selecting the plurality of address decoders together in block units and a block decoder for sequentially specifying each block unit.

Preferably, the block decoder decodes the upper address signal and uses one selector belonging to a specified block unit to select the address decoder belonging to the specified block, and the selected address decoder decodes the lower address signal and sequentially outputs selection pulses.

When the address counter counts the number of the clock signals inputted from the exterior and outputs the address signal, the address counter may be capable of switching between ascending order and descending order.

When the address counter counts the number of the clock signals inputted from the exterior and outputs the address signal, the address counter may be capable of changing the range of counting, and a screen partially appears in accordance with the changed range.

The pixels may be provided by an electro-optical material sandwiched between pixel electrodes formed on the substrate and counter electrodes opposite to the substrate.

The pixels may be driven by first thin film transistors formed on the substrate, and the first driving circuit and the second driving circuit may include second thin film transistors.

As set forth in the foregoing description, according to the present invention, the driving circuit peripherally included in the active matrix display device has the address counter for counting the number of clock signals inputted from the exterior and sequentially outputting the address signal, and a plurality of address decoders for decoding the address signal and sequentially outputting selection pulses. Employment of such an address decoding method makes it possible to avoid a display defect due to inferior transfer by the shift register, which is a conventional problem. In addition, the address decoding method basically enables random access, which readily realizes inverted display on the screen and separated displays on the screen.

DESCRIPTION OF THE PREFERRED EMBODIMENTS

Figure 1:
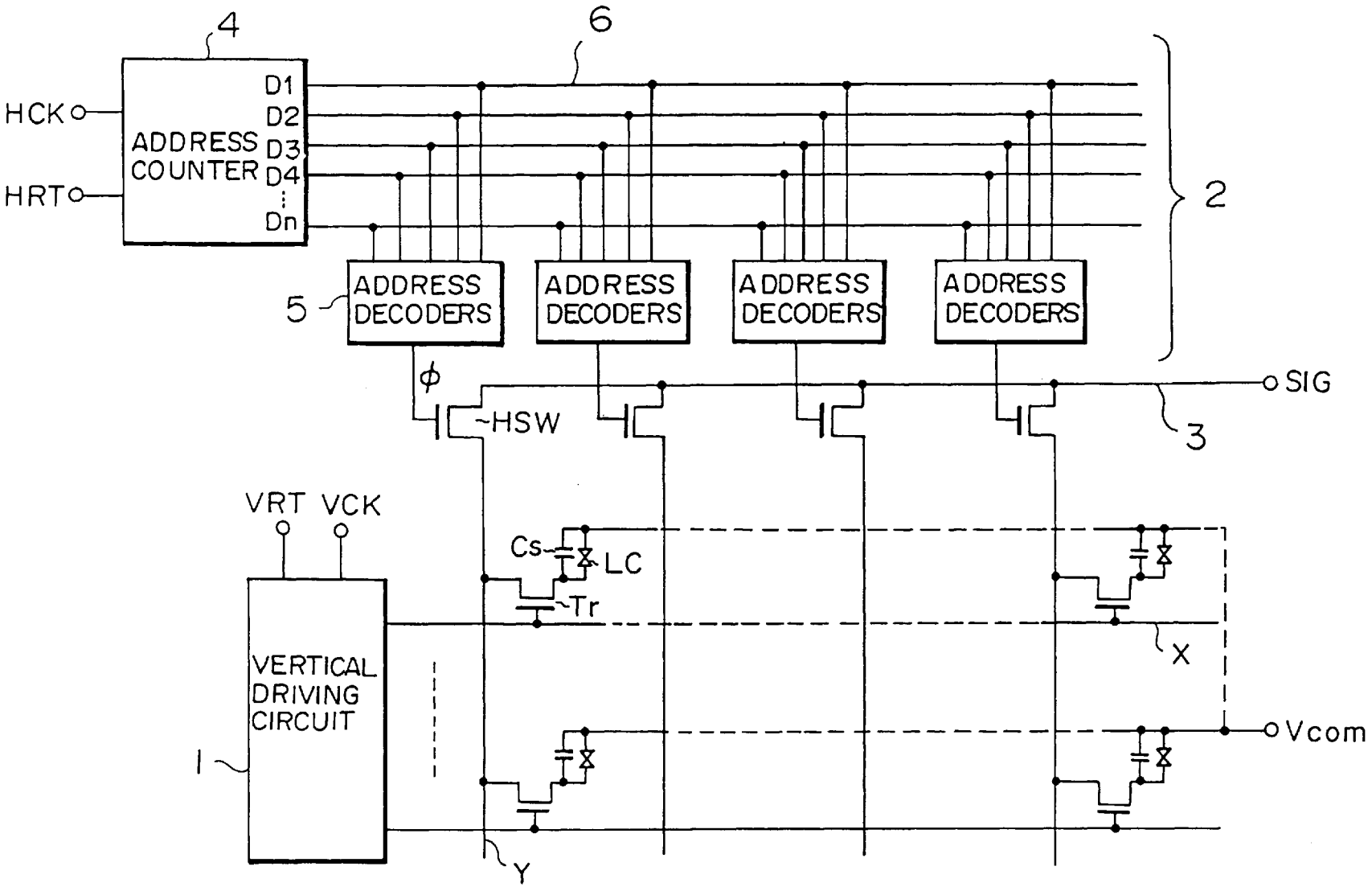
FIG. 1 is a block diagram showing the basic structure of an active matrix display device according to the present invention.

By referring to the drawings, preferred embodiments of the present invention will be described below.

FIG. 1 shows a block diagram of the basic structure of an active matrix display device according to the present invention. This active matrix display device includes a plurality of gate lines X and a plurality of data lines Y which are arranged so as to be mutually perpendicular in a screen, and pixels LC arranged where both lines intersect, which are selectively driven via the gate lines X and the data lines Y. The pixels LC has pixel electrodes formed on one electrode and counter electrodes formed on the other electrode, with an electro-optical material such as liquid crystal provided therebetween. A predetermined counter voltage $V_{com}$ is applied to the counter electrodes. The respective pixels LC are connected in parallel to additional capacitors Cs. In addition, thin film transistors Tr are formed so as to be integrated, as switching devices for driving the respective pixels LC. The source electrodes of the respective thin film transistors Tr are connected to the corresponding data lines Y, the drain electrodes are connected to the corresponding pixel electrodes, and the gate electrode are connected to the corresponding gate lines X. The active matrix display device includes a vertical driving circuit 1 and a horizontal driving circuit 2 in the periphery of a screen consisting of the pixels arranged in a matrix. These driving circuits 1, 2 are formed so as to be integrated outside the screen on the same substrate as the thin film transistors Tr. The vertical driving circuit 1, operating in accordance with both a vertical clock signal VCK and a vertical reset signal VRT supplied from an external timing generator, outputs selection pulses for sequentially selecting each gate line X. The horizontal driving circuit 2, also operating in accordance with a horizontal clock signal HCK and a horizontal reset signal HRT supplied from the external timing generator, outputs selection pulses $\phi$ for sequentially selecting each data line Y. In detail, the respective data lines Y are connected to a common input line 3 via switches HSW. This input line 3 is supplied with a video signal SIG from an external video driver. The horizontal driving circuit 2 sequentially outputs the selection pulses $\phi$ to control the switches HSW. Thereby, the video signal SIG is sequentially sampled for the data lines Y, and is written into the pixels LC via the thin film transistors Tr which are conductive.

The horizontal driving circuit 2 includes one address counter 4 and a plurality of address decoders 5. The address counter 4 counts the number of clock signals HCK inputted from the exterior, and sequentially outputs an address signal. Each address decoder 5 decodes the address signal, and sequentially outputs selection pulses $\phi$. The vertical driving circuit 1 similarly includes a combination of an address counter and address decoders. In this embodiment the address counter 4 supplies the address signal as parallel bit data D1, D2, D3, D4 to Dn to the address lines 6. Counting the number of the clock signals HCK by the address counter 4 is reset by a reset signal HRT as required, so that addressing is repeatedly performed for each horizontal period. To the contrary, each address decoder 5, connected in common to the address lines 6, decodes the parallel bit data D1, D2, D3, D4 to Dn, and outputs selection pulses $\phi$ when an address signal assigned to each address decoder is inputted. Thereby, the switch HSW operates and the video signal inputted from the exterior is sampled for the corresponding data line Y.

As described above, according to the present invention, in the horizontal driving circuit 2, the selection pulses $\phi$ for activating the switch HSW used in horizontal sampling are not formed by sequential driving with a shift register, but are formed by the address decoding method. By operating the address counter 4 with the clock signal inputted from the exterior and by decoding an address signal as the output of the address counter 4, the HSW at the desired position is activated to enable the sampling input of the video signal. In such a manner, the address decoders 5 become independent for each data line Y, thus, a fatal display defect such as a conventional transfer defect by the shift register can be avoided. It need hardly be said that the address decoding method can be applied to the vertical driving circuit 1.

Figure 2:
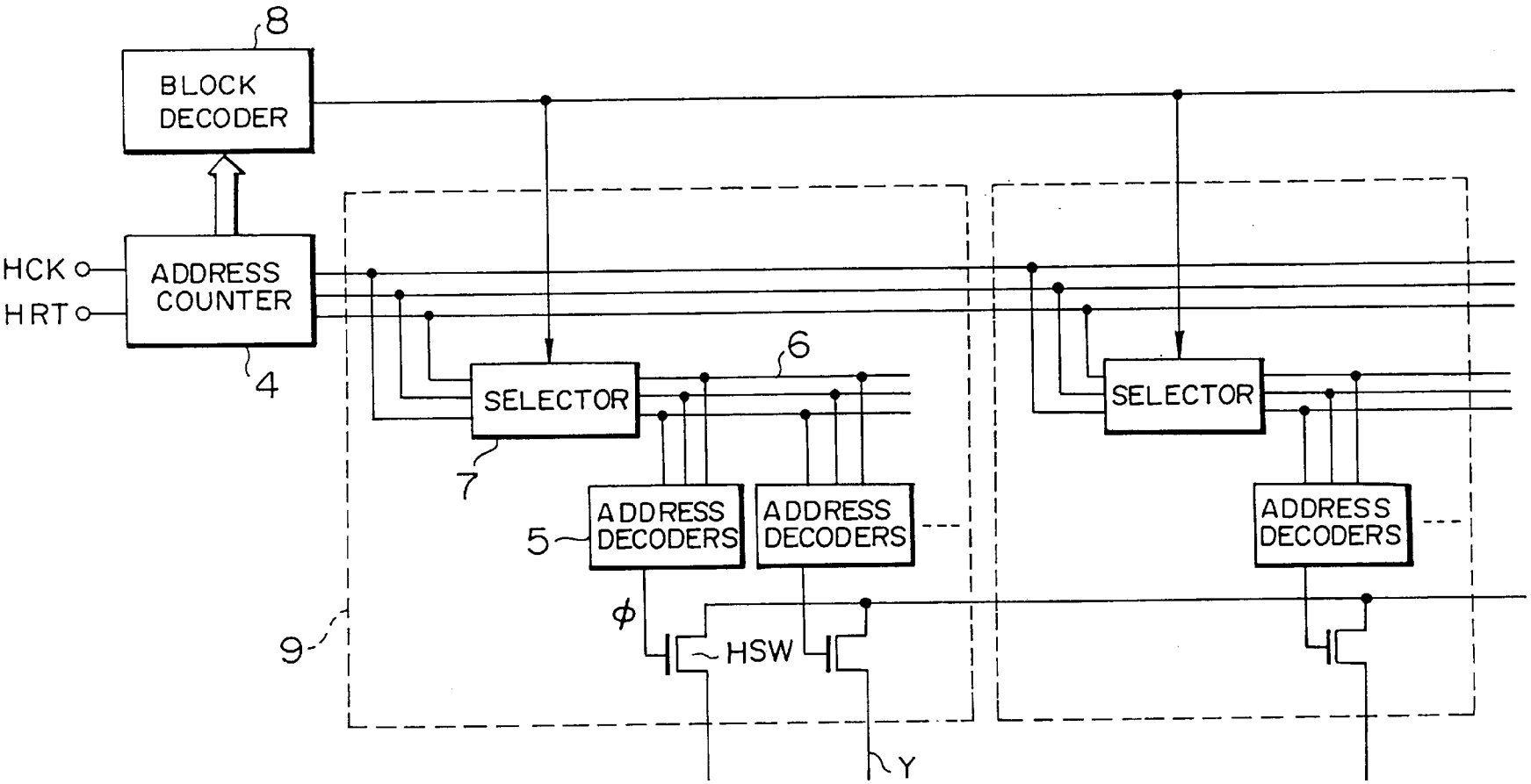
FIG. 2 is a block diagram showing a modification of a horizontal driving circuit included in the active matrix display device shown in FIG. 1.

FIG. 2 shows a schematic block diagram of a modification of the horizontal driving circuit shown in FIG. 1. Corresponding components are denoted by corresponding reference numerals, for being readily understood. In this modification, a plurality of selectors 7 and one block decoder 8 are added. The selector 7 selects a plurality of address decoders 5 together as a unit in block 9. The block decoder 8 sequentially specifies each block unit. In this case the address counter 4 supplies an address signal with it separated into an upper address signal and a lower address signal. The upper address signal is supplied to the block decoder 8, while the lower address signal is supplied to address lines 6. The block decoder 8 decodes the upper address signal and uses a selector belonging to a specified block unit to select the address decoder belonging to the specified block 9. The selected address decoder 5 decodes the lower address signal, and sequentially outputs selection pulses ϕ. In general, in the active matrix display device, the number of data lines and the number of gate lines which require addresses increase as the resolution increases. Accordingly, the number of bits in the address signal increases, therefore, the address lines increase and the number of devices in each address decoder increases. With these increases, an interconnecting pattern becomes complicated, which causes a decrease in yield rate. To avoid this decrease, a circuit arrangement in which a circuit is separated into blocks and address decoding is performed in each block as shown in FIG. 2 is employed. Thereby, it is possible to solve, to some extent, the complications of the pattern with the increasing resolution. In the modification, by appropriately adjusting the number of input bits and the number of blocks with respect to each address decoder 5, the most efficient pattern and unit design may be selected.

Figure 3:
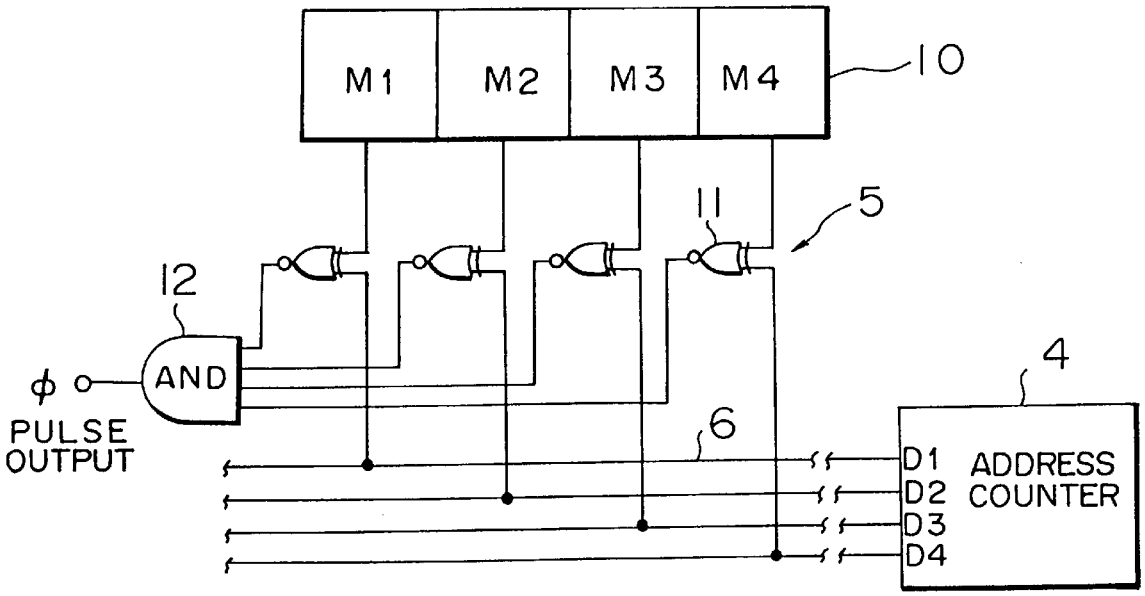
FIG. 3 is a detailed block diagram showing an address decoder included in the active matrix display device shown in FIG. 1.

FIG. 3 shows a detailed diagram of the address decoder 5. The address decoder 5 includes a memory 10 in which an address assigned for the address decoder itself is stored. In this example, for simplification, the memory 10 is a 4-bit memory, and stores four binary bit data M1, M2, M3 and M4 as its own address. The output terminals of the 4-bit memory 10 are connected to corresponding coincidence circuits 11. The coincidence circuits 11 can consist of, for example, exclusive OR gates having inverting outputs. The coincidence circuits 11 further have input terminals connected to the address lines 6, and receive the parallel bit data D1, D2, D3 and D4 from the address counter 4. When the address data M1, M2, M3 and M4 from the memory 10 coincide on the address data D1, D2, D3 and D4 supplied from the address counter, the coincidence circuits 11 disposed for the respective bits simultaneously output coincidence signals, and the AND gate (AND) 12 outputs the selection pulses ϕ.

Figure 4:
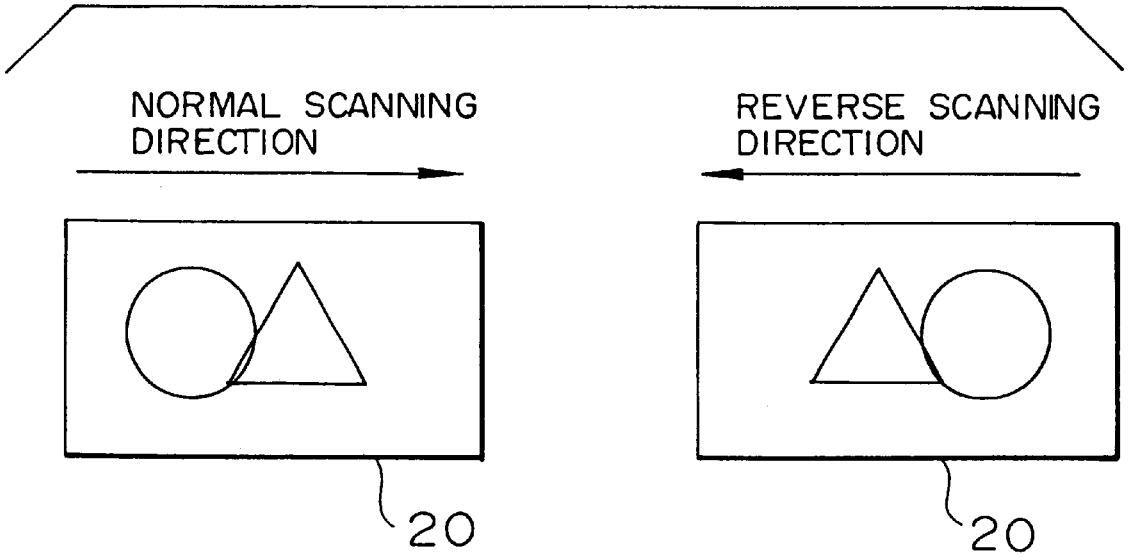
FIG. 4 is a schematic chart illustrating a modification of the active matrix display device according to the present invention.

FIG. 4 illustrates a modification of the active matrix display device according to the present invention. In this modification, when counting the number of the clock signals HCK inputted from the exterior and outputting the address signal, the address counter can switch between ascending order and descending order, and in accordance with the order, a screen 20 can switch between normal display and inverted display. In other words, when the address counter 4 included in the horizontal driving circuit 2 counts the number of the clock signals in ascending order, the screen 20 is scanned in the normal direction from left to right. To the contrary, when the address counter counts the number of clock signals in descending order, the screen is scanned in the reverse direction. In such a manner, according to the present invention, the horizontal driving circuit can easily become a bi-directional type. By sequentially scanning the respective data lines Y along the row direction from one end of the gate lines X to another end (the right direction in FIG. 4) or along the reverse direction (the left direction in FIG. 4), the screen display can be inverted right or left. This right/left inversion function is needed when, for example, the active matrix display device is applied to a light bulb in a projector. The projector includes three active matrix display devices to which three primary colors are assigned, and a common enlarging projection lens system. The respective display devices function as light bulbs, separately, in color systems of red, green and blue. The respective display devices display primary images with them decomposed into color components of red, green and blue. At the same time, light rays of red, green and blue are incident upon the respective display devices. After monochromatic transmitted light images in the display devices are composed by a dichroic prism or dichroic mirror, the composed image of multi-colors is projected onto the screen so as to be enlarged by the projection lens system. In the optical system of the projector the primary images are composed after being reflectively inverted several times. Depending upon the configuration of the optical system, the number of reflective inversions are different in the respective color systems. Consequently, to obtain a coordinated, multi-color image, the primary image of a specified color needs to be predeterminedly inverted.

Figure 5:
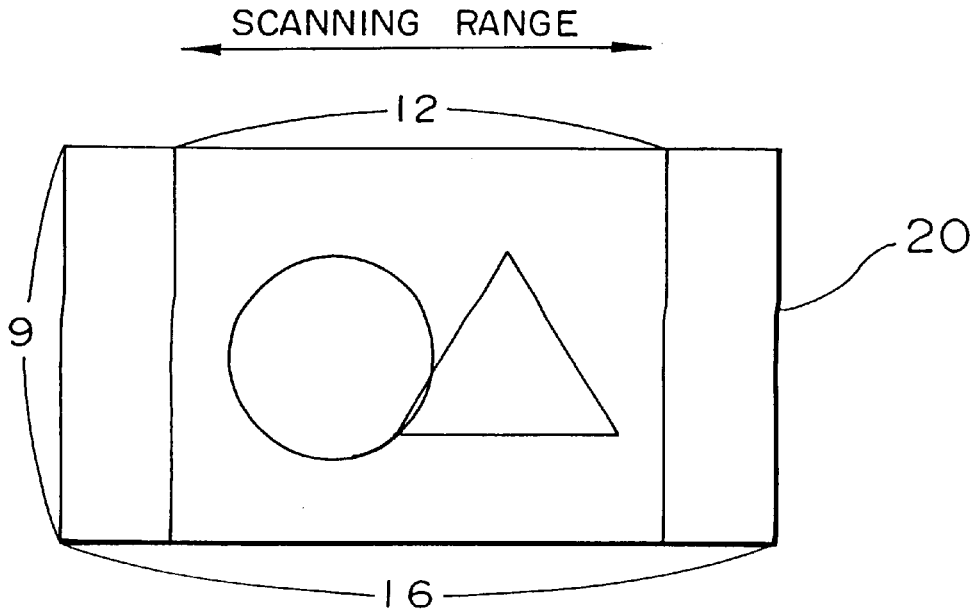
FIG. 5 is a schematic chart illustrating another modification of the active matrix display device according to the present invention.
Figure 6:
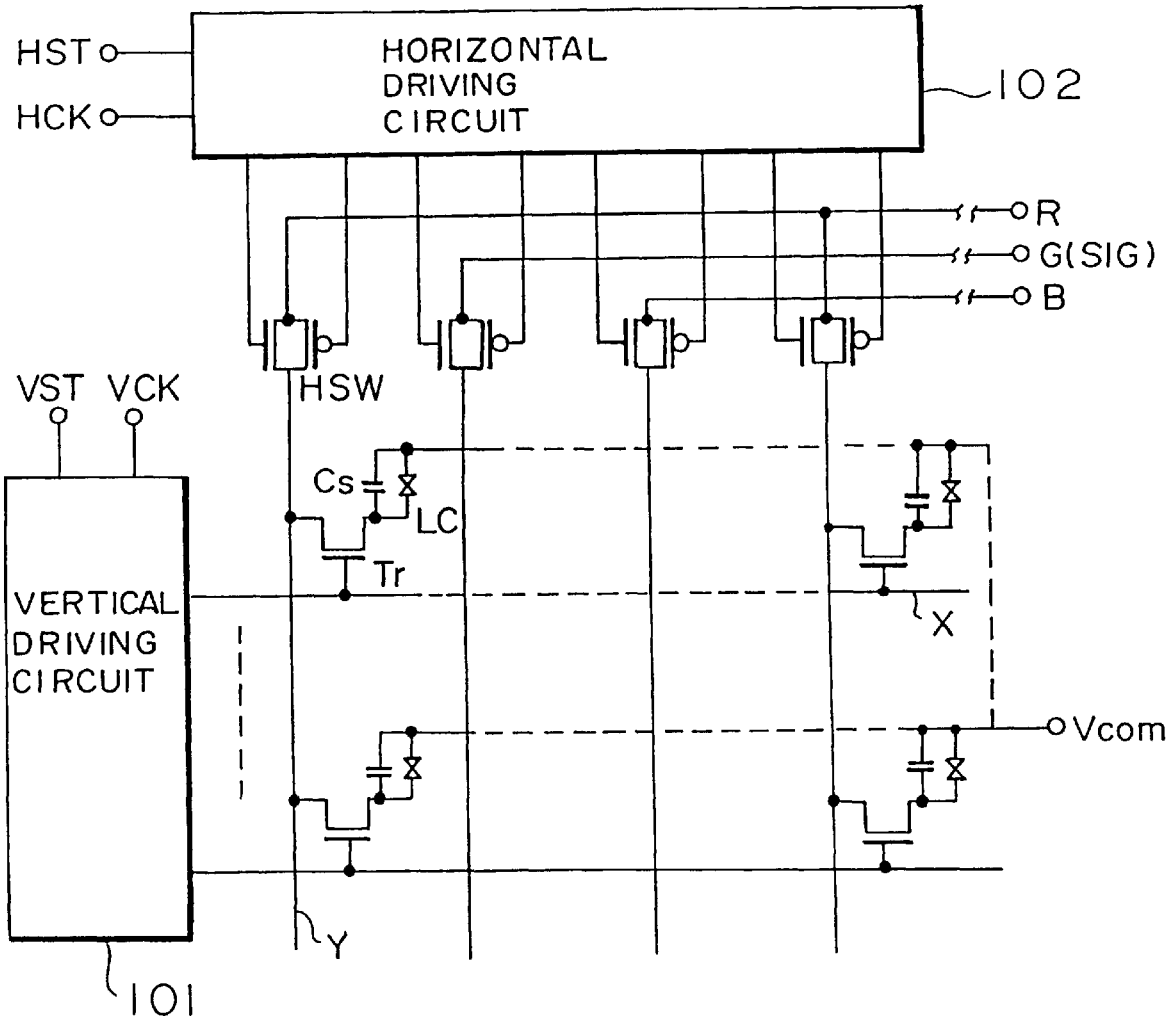
FIG. 6 (PRIOR ART)
FIG. 6 is a block diagram showing one example of a conventional active matrix display device.
Figure 7:
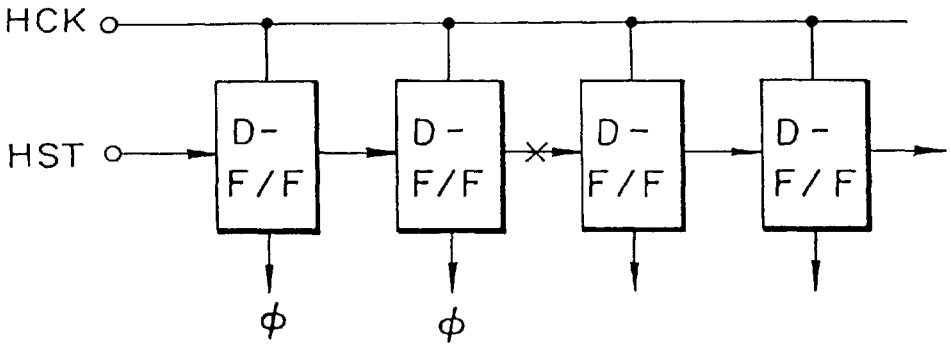
FIG. 7 (PRIOR ART)
FIG. 7 is a block diagram showing an example of a horizontal driving circuit included in the active matrix display device shown in FIG. 6.

FIG. 5 shows a block diagram of another modification of the active matrix display device according to the present invention. In accordance with this modification, when the address counter counts the number of the clock signals inputted from the exterior and outputs the address signal, the range of counting can be changeable, and the screen partially appears in accordance with the changed range. To change the range of counting, for example, a predetermined initial value may be given as a reset signal which is inputted from the exterior. In this modification the screen 20 has an angle of view which is 16:9 according to the wide standard for the HDTV and so forth. Apart from the screen 20, there are cases in which a video image according to the normal standard for the NTSC, the PAL or so forth is supplied. In this normal standard a determined angle of view (aspect ratio) is 4:3. Accordingly, when the address counter in the horizontal driving circuit counts the number of the clock signals inputted from the exterior and outputs the address signal, the address counter limits the range of counting. Thereby, the horizontal scanning range on the screen 20 is limited to the rough center of the wide screen 20. Such a manner enables the normal screen, having an angle of view which is 4:3, to partially appear with respect to the wide screen 20.

What is claimed is:

1. An active matrix display device, comprising:

a plurality of gate lines and a plurality of data lines formed on a substrate so as to be mutually perpendicular;

a plurality of pixels arranged at intersections of said gate lines and said data lines;

a plurality of first thin film transistors formed on said substrate and arranged at intersections of said gate lines and said data lines, said plurality of first thin film transistors serving as switching devices for driving said plurality of pixels;

a first driving circuit formed of second thin film transistors on said substrate for outputting selection pulses selecting each gate line;

a second driving circuit formed of second thin film transistors on said substrate for outputting selection pulses selecting each data line; and wherein at least one of said first driving circuit and said second driving circuit includes an address counter for counting a number of clock signals inputted from an external time generator and for sequentially outputting an address signal as parallel bit data simultaneously to a plurality of address lines, further including an address decoder for each of said gate lines and/or data lines for decoding said address signal and sequentially outputting the respective selection pulses, and each said plurality of address lines connected to each address decoder.

2. An active matrix display device according to claim 1, wherein said address counter supplies said address signal as parallel bit to address lines, and each address decoder connected in common to said address lines decodes said parallel bit data and outputs the selection pulses when an address signal assigned to the address decoder is inputted.

3. An active matrix display device according to claim 1, wherein said address counter supplies said address signal separated into an upper address signal and a lower address signal, and said active matrix display device includes selectors for selecting said plurality of address decoders together in block units and further includes a decoder for sequentially specifying each block unit.

4. An active matrix display device according to claim 3, wherein said block decoder decodes said upper address signal and uses one selector belonging to a specified block unit to select the address decoder belonging to the specified block, and said selected address decoder decodes said lower address signal and sequentially outputs the respective selection pulses.

5. An active matrix display device according to claim 1, wherein, when said address counter counts the number of said clock signals inputted from the external time generator and outputs said address signal, said address counter being capable of switching between ascending order and descending order.

6. An active matrix display device according to claim 1, wherein, when said address counter counts the number of said clock signals inputted from the external time generator and outputs said address signal, said address counter being capable of changing a range of counting with a screen partially appearing in accordance with the changed range.

7. An active matrix display device according to claim 1, wherein said pixels are provided by an electro-optical material sandwiched between pixel electrodes formed on said substrate and counter electrodes opposite to said substrate.

8. An active matrix display device according to claim 1, wherein said pixels are driven by first thin film transistors formed on said substrate, and said first driving circuit and said second driving circuit include second thin film transistors.

* * * * *